United States Patent [19]

Hoffman

[11] 4,332,458

[45] Jun. 1, 1982

[54] TABLE TOP COPY MACHINE

[75] Inventor: Lionel B. Hoffman, Wykoff, N.J.

[73] Assignee: Pitney Bowes Inc., Stamford, Conn.

[21] Appl. No.: 165,998

[22] Filed: Jul. 7, 1980

Related U.S. Application Data

[63] Continuation of Ser. No. 947,873, Oct. 2, 1978, abandoned.

[51] Int. Cl.[3] ..... G03G 15/00; B65H 17/12

[52] U.S. Cl. ..... 355/3 BE; 198/806

[58] Field of Search ..... 355/3 BE, 3 FU, 8, 14 R, 355/16; 198/806, 807, 840

[56] References Cited

U.S. PATENT DOCUMENTS

| | | | |
|---|---|---|---|
| 3,647,293 | 3/1972 | Queener | 355/15 |
| 3,818,391 | 6/1974 | Jordon et al. | 355/3 BE |
| 3,914,047 | 10/1975 | Hunt, Jr. et al. | 355/16 |
| 3,966,316 | 6/1976 | Pfeifer et al. | 355/15 X |
| 3,988,061 | 10/1976 | Root | 355/3 FU |
| 3,997,262 | 12/1976 | Doi et al. | 355/8 X |
| 4,013,359 | 3/1977 | Dubois et al. | 355/16 |
| 4,025,180 | 5/1977 | Kurita et al. | 355/16 X |
| 4,025,188 | 5/1977 | Radler, Jr. et al. | 355/16 |
| 4,174,171 | 11/1979 | Hamaker et al. | 355/3 BE |
| 4,197,002 | 4/1980 | Hamaker et al. | 355/3 BE |

*Primary Examiner*—J. V. Truhe
*Assistant Examiner*—Keith E. George
*Attorney, Agent, or Firm*—Lawrence E. Sklar; Martin D. Wittstein; William D. Soltow, Jr.

[57] ABSTRACT

A compact, table top plain paper copy machine has a teardrop shaped photoreceptor belt. A reciprocating carriage scan exposes an original document to the photoreceptor through an optical system having a Z-shaped optical path. The optical system and a number of other processing stations are located directly underneath the carriage thereby contributing to the overall compactness of the machine. A pair of pressure fusing rollers fix a dry toned image to a plain paper copy sheet, so that no energy is required to maintain the machine in a warm-up or stand-by mode of operation.

8 Claims, 18 Drawing Figures

44
125
123
127a
170
171
126
127b
42
39
40
44
42
142b
121
122
95
130
102

TABLE TOP COPY MACHINE

This is a continuation of application Ser. No. 947,873, filed Oct. 2, 1978, now abandoned.

BACKGROUND OF INVENTION

1. Field of the Invention

This invention relates generally to electrophotographic copying machines, and, in particular, to a compact, table top plain paper copy machine that consumes a minimal amount of energy.

2. Description of the Prior Art

Plain paper electrophotocopying machines are well-known devices that reproduce images of original documents on ordinary or plain paper. Such machines typically include a reusable photoreceptor including a conductive substrate coated with a photoconductive material, a supply of plain paper copy sheets, and a plurality of processing stations for operating on the photoconductor and the copy sheets. In a typical sequential copying process, the photoconductor is uniformly charged and then exposed to an illuminated, original document. The areas of the photoreceptor that are struck by the image of the indicia carried on the original retain their charge and the charge in the light-struck areas is dissipated. Thus, a latent electrostatic image is formed on the photoconductive coating of the photoreceptor. Next, the latent image is developed by contacting the photoreceptor with electrically attractable toner particles which adhere to the charged areas of the photoconductive coating that make up the latent image. The toned image is next transferred to the copy sheet where the toner is fused onto the sheet to fix the image thereon.

Early models of plain paper copiers were, in general, large, expensive and complex machines that constantly consumed energy, even in an idle or stand-by mode. Such machines were large in size since they used either a relatively large radius drum for supporting a photoreceptor or used a belt or web type photoreceptor that moved through an elongated path past the copy processing stations. Unfortunately, such machines are not practical for some users who have a limited amount of office space or modest copying requirements.

Accordingly, others have attempted to reduce the size of plain paper copiers ad otherwise simplify their operation in order to meet the spatial and economic requirements of the relatively low volume user who desires plain paper copies. See, for example, U.S. Pat. Nos. 4,012,138, 4,017,170, 3,819,261 and 3,606,532 as illustrative of such attempts. However, the devices as described in the above patents suffer from one or more drawbacks including the use of a drum supported photoreceptor which occupies a relatively large volume of space, a moving optical system which can be expensive and complex in operation, separate toning and cleaning stations, and a fuser that constantly requires energy even when copies are not being made. Such attempts at size reduction often result in devices that are difficult to service since access to key operating components in need of service may be obscured by other closely spaced components. Accordingly, there is a need for a compact machine with closely spaced and readily accessible operating components.

A number of copy machines employ a belt or web type of photoreceptor. Such photoreceptors will naturally track to one side of the pulley or roller that supports the belt, thus misaligning the photoreceptor. Others have solved this problem by using crowned drive and support rollers. But such solutions are expensive so there remains an unfilled need for a relatively simple and inexpensive belt alignment system.

SUMMARY

It is therefore an object of this invention to provide a new and useful compact, table top size plain paper copy machine.

It is another object to provide a copy machine that consumes a minimal amount of energy.

It is a further object to provide a copy machine that consumes energy only when the machine is actively making copies.

It is also an object to use a relatively short photoreceptor belt.

Still another object is to support the photoreceptor belt between two rollers of unequal size.

An additional object is to skew the axes of the rollers to track the photoreceptor in one direction.

It is also an object to use a Z-shaped optical path and to dispose substantially all of a number of processing stations and the photoreceptor between the ends of the optical path.

Another object is to provide a control system for rotating the photoreceptor belt through two cycles for each desired copy of an original and for controlling the sequential operation of the processing stations during each cycle. It is an object to mount a number of processing stations on a hinged upper support assembly in order to rotatably move the mounted stations and thereby gain access to the rest of the machine.

It is a still further object to provide a lower removable copy paper feed support assembly for gaining further access to the machine.

It is an object to have a common actuating means for skewing the rollers, moving the developer to its operative position and for supporting the drive roller.

In summary, the invention is for a copy machine that achieves the above and other objects in a manner described briefly below and in more detail hereinafter.

The invention includes a photoreceptor belt supported by two rollers having different, unequal diameters, i.e. a relatively large diameter drive roller and a relatively small diameter roller. Thus, the photoreceptor belt assumes a shape resembling a teardrop. The invention is housed in a rectangular cabinet with the large roller disposed across one upper corner and the smaller roller generally diagonally displaced from the larger roller.

In the invention, the photoreceptor belt is kept in proper alignment by deliberately predisposing the axes of the two rollers at an angle to each other. That predisposition of the rollers causes the photoreceptor belt to track or move laterally to one side as the rollers turn. In the preferred embodiment, the necessary angular displacement is accomplished by skewing the smaller roller. A flange is located on the end of the larger roller toward which the belt tracks. The flange prevents the belt from tracking off the rollers and thus maintains the belt in proper alignment with the other processings stations.

A plurality of processing stations and other operating elements are disposed around the outer surface of the photoreceptor belt. A charging station and a developing station are located adjacent to the larger roller. A transfer station and copy sheet feeding means are located near the smaller roller. Erasing and discharging stations are located between the smaller roller and larger roller and juxtaposed to the transfer station and copy sheet feeding means.

The invention uses a reciprocating carriage to scan expose a document across an illuminating station that comprises an exposure slit located on the top of the cabinet, underneath the reciprocating carriage. A Z-shaped optical path carries an image of the scanned document from the exposure slit to an imaging station that is located between the charging and developing stations. Most of the processing stations and other key operating means are disposed between the two ends of the Z-shaped optical path, thereby contributing to the overall compactness of the invention.

The invention has a hinged upper support assembly that holds a number of the processing stations. More specifically, the upper support assembly includes an array of incandescent erase lamps, a discharging or neutralizing station, the carriage, the illuminating station including the exposure slit and illuminating lamps, the optical system (two tilted mirrors with a lens disposed between them) and the charging station. The upper support assembly is positioned on the top of the cabinet that houses the copy machine. The assembly is connected to the cabinet by a hinge that extends across the width of the cabinet thus permitting the assembly to be raised in a clam shell-like manner. That kind of connection allows one to have easy access to the rest of the copy machine that lies underneath the upper support assembly.

The invention further includes a lower support assembly that supports a number of operating elements that are disposed underneath the photoreceptor. The lower support assembly holds a copy sheet supply tray in which a stack of plain paper copy sheets are stored for use in making copies. The lower support assembly also supports a pair of queuing rollers and a transfer station. The queuing rollers receive a copy sheet that is fed into their nip and delay the further feeding until the proper moment when the copy sheet is fed through the queuing rollers to contact and be properly aligned with the toned or developed image that is carried on the photoreceptor belt. The copy sheet supply tray is slidably removable and insertable from the lower support assembly for replenishing the copy sheet supply or changing the size of the copy sheets. In addition, the entire lower support assembly is completely removable in order to permit one to have access to the underside of the photoreceptor and the developer. The lower support assembly is adapted to be removable from the machine in a direction opposite to the direction of travel of the copy sheets. The latter feature is especially advantageous in clearing any paper jams which may occur since removing the lower support assembly will tend to loosen or unbind any jammed copy sheets and thereby avoid damage to such fragile elements such as the transfer station and the photoreceptor belt.

The lower support assembly is further adapted to actuate a number of key operating elements or stations by moving them into and out of their proper respective positions. A combination of mechanical linkages and cams connect the larger roller and the developing station (a magnetic brush developer) with the lower assembly. With the lower assembly withdrawn, the idler roller is displaced toward the drive roller so that the photoreceptor belt is relaxed. Also, the magnetic brush is displaced away from its operative position that is in registration with the photoreceptor belt. As such, the photoreceptor belt can be replaced and the magnetic brush is accessible for service or replenishment of toner. When the lower assembly is fully inserted, the linkage and cam combination acts and causes the smaller roller to displace or move to its normal, operative position, thereby tensioning the photoconductor belt and disposing the axis of the larger roller at an angle to the smaller roller. In addition, the magnetic brush is displaced toward its operative position in registration with the photoreceptor belt.

The lower support assembly also provides some support for the larger roller which is primarily cantilevered on the cabinet. A post mounted on the lower support assembly engages the unsupported end of the larger roller to provide added support and alignment of the larger roller and the photoreceptor with the other processing stations and operating elements.

No energy is needed to maintain the copier in a standby mode of operation. Moreover, the developing and fixing stations of the invention jointly contribute to the relatively low energy requirements of the copies during active copying. To this end, the developing station includes a magnetic brush developer that is capable of using any suitable, pressure fixable toner. The developing station also functions as a cleaning station for removing untransferred toner from the photoreceptor belt, thereby obviating the need for a separate cleaning apparatus that would normally include a vacuum device. The fixing station includes a pair of pressure fixing rollers for receiving a copy sheet bearing a toned or developed image. The pressure exerted on the copy sheet and toner by the fixing rollers is sufficient to permanently fix the toner to the copy sheet, thereby obviating the need for an electrically heated fusing apparatus.

The control system for the invention includes a bank of cams that operate a corresponding bank of control switches which in turn selectively energize certain processing stations and other key operating elements. For each copy, the control system causes the photoreceptor belt to move through two cycles. At the start of the first cycle, the larger roller is clutched to a main motor, the magnetic brush starts turning and the carriage moves from a home position across the exposure slit. Substantially simultaneously with the start of the first cycle, the control system energizes the lamp of the illuminating station and the charging station. During the first revolution, the copy sheet is fed into the queuing rollers. At a predetermined time, the control system actuates the queuing rollers so that the copy sheet is fed into contact and aligned with the toned image and the transfer of toner to the copy sheet is begun. As the leading edge of the imaged portion of the photoreceptor passes around the smaller roller, the copy sheet is separated from the photoreceptor and is guided into the nip of the pressure fixing rollers. The leading edge of the residual latent image together with any untransferred toner then passes by the erase lamps and discharge station, both of which are substantially energized for the entire copying process.

As the photoreceptor begins its second revolution, the carriage starts its return to its initial position. The control system de-energizes the charging corona and the illuminating lamps. The latter is necessary in order to clean the untransferred toner from the photoreceptor. As the photoreceptor passes the magnetic brush during the second cycle, the untransferred toner particles are attracted to the brush since substantially all the electrostatic charge on the toner was neutralized at the discharge station. The transfer corona is de-energized after a predetermined time during the first cycle in order not to charge the non-imaged portions of the photoreceptor. If only one copy is to be made, then at the end of the second cycle the entire copier is de-energized. When multiple copies are made, the foregoing sequence of events is repeated for each copy until the desired number of copies are made and then the copier is de-energized.

Having briefly described the salient features of the preferred embodiment, the reader is now referred to the accompanying drawings identified below, the detailed description of the preferred embodiment hereinafter, and to the appended claims for a full description of the spirit and scope of the invention.

DRAWINGS

Figure 8:
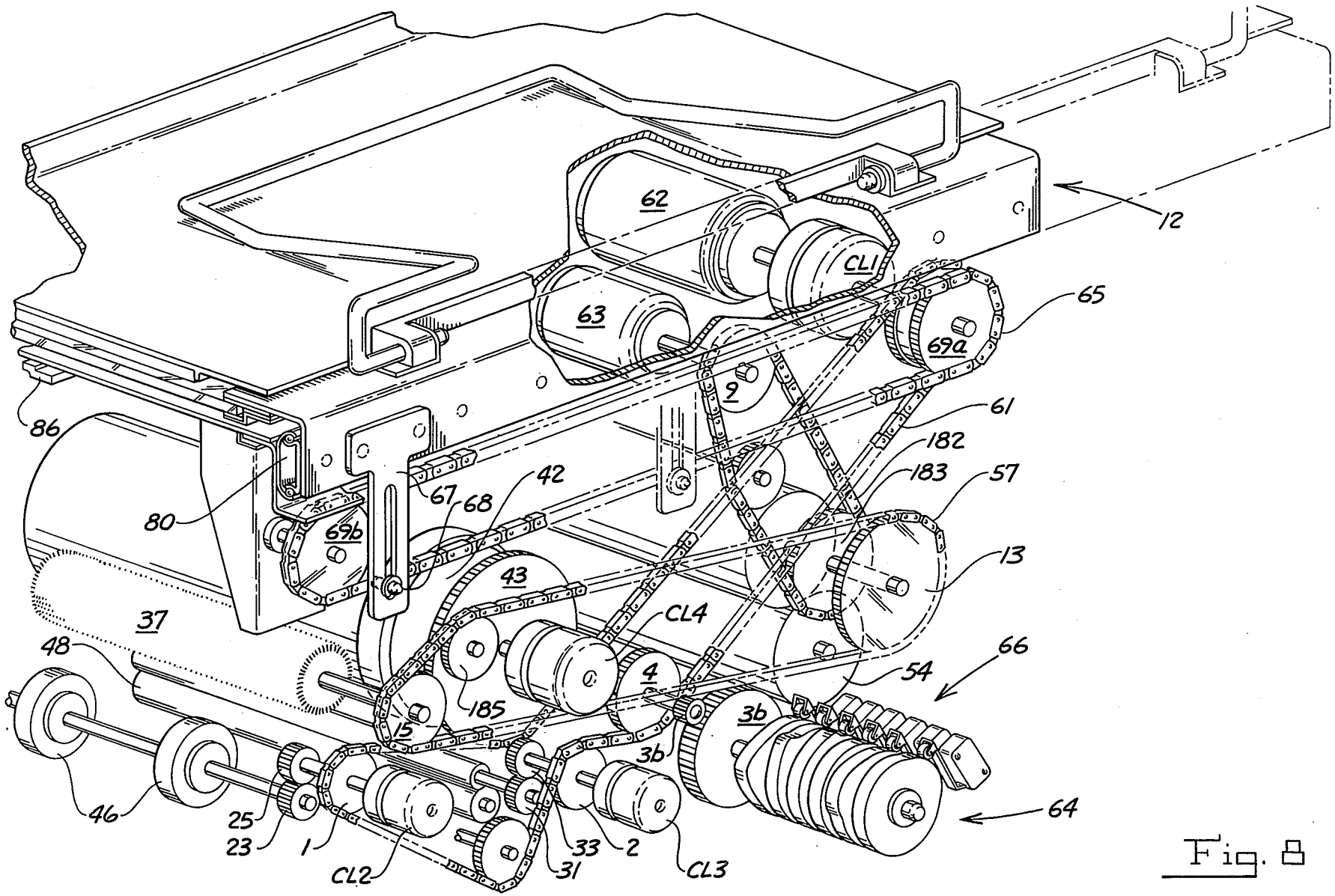
Figure 5:
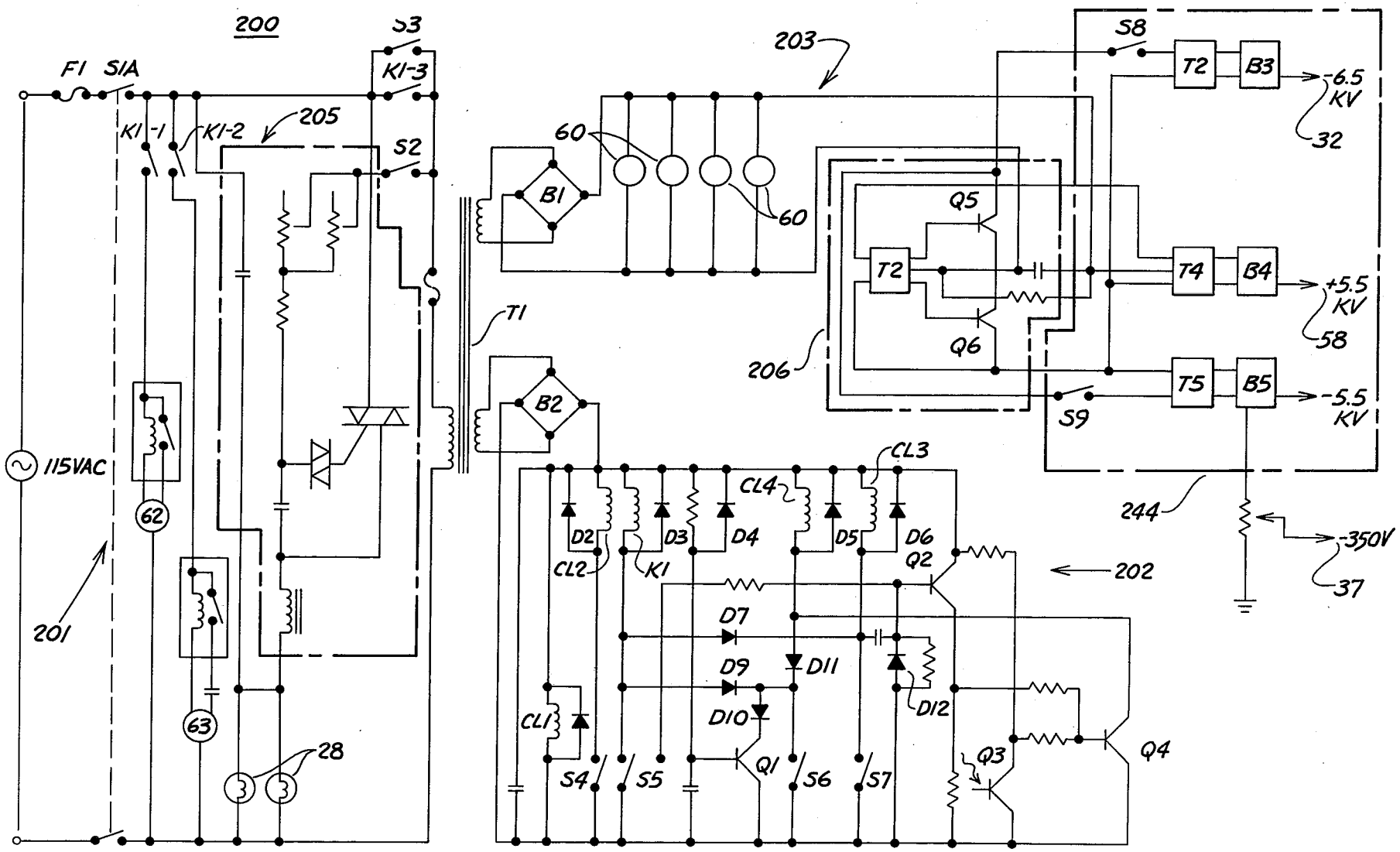

FIGS. 7A–F are a series of views that show the retaining cams;

FIG. 8 is a schematic perspective view of the drive system and is slightly exaggerated in portions to show the driving relationships among the drive system components.

Figure 10:
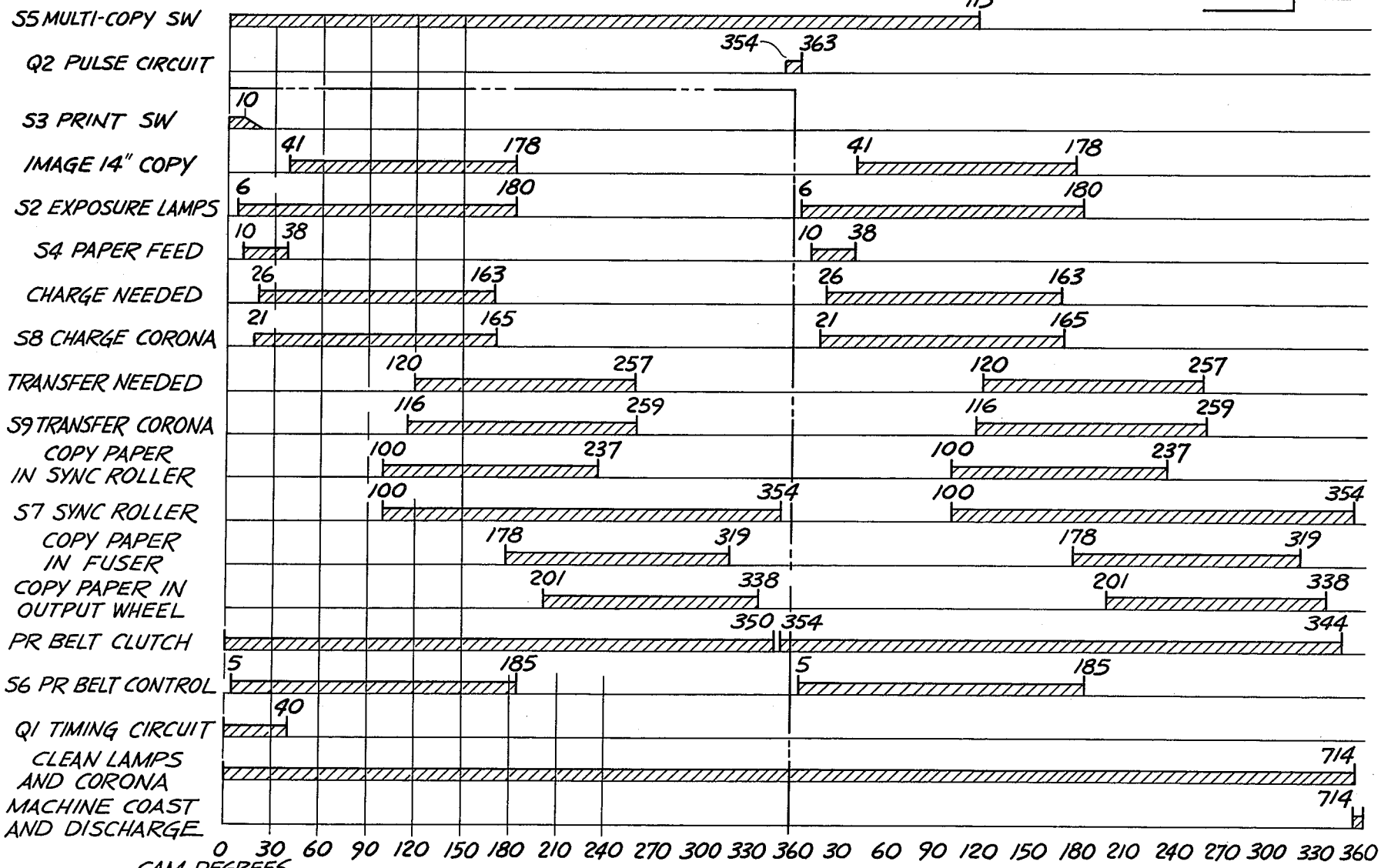

FIG. 9 is an electrical schematic view of the control system of the copier;

FIG. 10 is a bar chart illustration of the sequence of operations of the copier during the single and multicopy modes of operation;

DETAILED DESCRIPTION

The Operating Components

The copier 10 has a rectangular reciprocating carriage 12 that is movably mounted on top of a cabinet 11. The carriage 12 includes a transparent platen 14 on which documents are placed faced down for copying. Overlying the platen 14 is an opaque, movable cover 16 which has a white surface juxtaposed to the platen 14. The cover 16 is connected to one side of the carriage 12. In the preferred embodiment, the cover 16 is made of a relatively flexible material that is connected by a hinge to one of the longer sides of the carriage 12. The cover 16 has a handle 17 disposed opposite to the hinged side of the cover 16. An operator can manipulate the handle 17 in order to raise and lower the cover 16 and thereby place on or remove documents from the platen 14.

Figure 1:
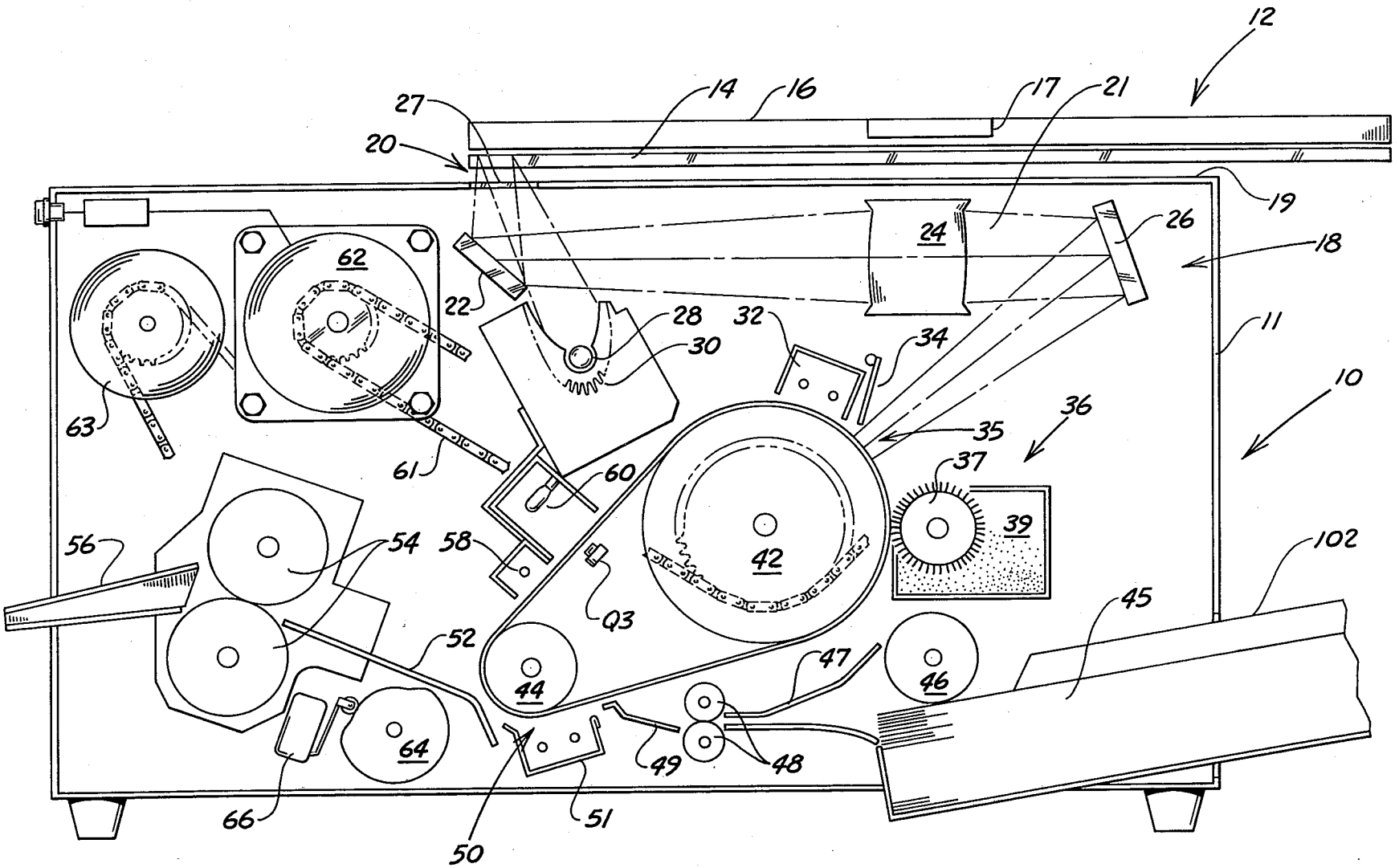
FIG. 1 is a mechanical schematic elevation of the copy machine of the invention.

The carriage 12 is shown in FIG. 1 in its extreme right or home position. During a copy cycle, the carriage moves to the left a predetermined distance that is long enough to enable the copier 10 to make copies of fourteen inch long documents. Underneath the carriage is an illuminating station, generally indicated at 20. The illuminating station 20 includes a relatively narrow, transparent window 27 that is mounted on the upper surface 19 of cabinet 11. The window 27 extends across the width of upper surface 19. A light source is operatively disposed underneath window. The light source comprises two lamps 28 axially aligned and partially surrounded by a shaped reflector 30 which serves to direct the light from the lamps 28 toward the window 27. As the carriage 12 moves from right to left, a document on the carriage passes over illumination window 27 and is illuminated by the light from lamps 28. In other words, the document is scan exposed across the illuminating station 20.

An image of the document is transmitted to the photoreceptor belt 40 at an imaging station generally designated 35. The image is transmitted along a Z-shaped path by optical system 21 comprising tilted mirrors 22, 26 and lens 24. Mirror 22 receives an image of the illuminated document as the latter passes over window 27. Mirror 22 reflects the image toward converging lens 24. Lens 24 is focused upon second tilted mirror 26 which in turn reflects the focused image onto a portion of the photoreceptor belt 40 at the imaging station 35. The photoreceptor belt 40 is moved through the imaging station at a predetermined speed in synchronism with the movement of the carriage 12 across the illuminating station 20. The motive power for turning the drive roller 42 is supplied by a main motor 62 through a suitable drive system that includes drive chain 61 (partially shown). Chain 61 also drives other elements including the magnetic brush 37, the carriage 12, and the feed and queuing rollers 46, 48. Control cams 64 and the fixing rollers 54 are driven by a second motor 63.

As mentioned above, the photoreceptor belt 40 is supported underneath the Z-shaped optical system 21 by a relatively large diameter drive roller 42 and a relatively small diameter idler roller 44. The rollers 42, 44 are diagonally displaced from each other and their respective axes are angularly disposed with respect to each other, i.e., the axes are skewed or not parallel. By virtue of the relative difference in size between the two rollers 42, 44, the photoreceptor belt 40 takes on a shape similar to a teardrop. The belt 40 itself comprises an upper photosensitive layer, preferably of zinc oxide (ZnO) that is coated on a conductive substrate, preferably one made of metalized polyester film, such as Mylar brand film with an aluminum base.

Disposed around the periphery of the photoreceptor belt 40 are a number of the operating components of the copier 10. In particular, a two-wire corona charging unit 32 is juxtaposed to the photoreceptor belt 40 at approximately a one o'clock position with respect to the drive roller 42. The charging unit 32 is operable to impart a uniform electrostatic charge to the zinc oxide surface of the photoreceptor 40. The drive roller 42 turns in a clockwise direction, so that the uniformly charged surface of the photoconductor belt moves from the charging unit 32 toward the imaging station 35. A blade-like shutter 34 is operatively associated with the imaging station. The shutter 34 is movably mounted in the copier 10 for manipulation by an operator in order to adjust the amount of light that strikes the photoreceptor 40 at the imaging station 35. In accordance with the well-known photocopying technique, the light-struck areas of the photoreceptor belt 40 are electrically discharged, thereby leaving a latent (undeveloped) electrostatic image that corresponds to the indicia areas (printed portions) of the document that is to be copied.

As drive roller 42 turns, the latent image on photoreceptor belt 40 is carried past a developer station 36 disposed at a three o'clock position with respect to the drive roller 42. The developer station 36 includes a hopper 39 for holding a supply of toner. The preferred embodiment of the invention uses a two component toner consisting of iron filings and pressure fixable marking material; however, a single component toner can also be used. Such toners and developer stations are well-known in the art and so it is only necessary to discuss them to the extent of their function in the overall copying process that is carried on by the copier 10. Suffice it to say that a rotating magnetic brush 37 picks up toner from the hopper 39 and carries that toner into contact with the photoreceptor 40. The charged or latent image areas of the photoreceptor electrostatically attract and hold toner particles, thus developing the latent image.

The toned or developed image leaves the developer station 36 and moves toward the transfer station 50 where there is a two-wire corona transfer charging apparatus 51. In timed relationship with the arrival of the toned image at the transfer corona 51, a copy sheet also arrives at the transfer station 50. The copy sheet is fed from a supply of sheets 45 stored in a removable tray 102. A feed roller 46 feeds the uppermost copy sheet from the supply 45, through paper guide 47 and into the nip of queuing rollers 48. At a predetermined time in the course of a copy cycle, the queuing rollers 48 are actuated to feed the copy sheet along paper guide 49 and into contact with the developed image carried on the photoreceptor belt 40. By virtue of the electric charge that is generated by the transfer corona 51, toner particles are attracted from the photoreceptor belt 40 toward the copy sheet to which they loosely adhere.

The copy sheet is separated from the photoreceptor belt 40 by the interaction of the small diameter idler roller 44 with the relative stiffness of the copy sheet. In other words, as the photoreceptor passes around the idler roller 44, the copy sheet does not follow the belt 40. Instead, the leading edge of the copy sheet moves away from the belt along a path that is initially tangent to the idler roller 44. The copy sheet is ultimately guided by paper guide 52 into the nip of pressure fixing rollers 54.

Pressure fixing rollers 54 include two stainless steel rollers that are spring loaded into contact with each other with a linear pressure of approximately three hundred pounds per linear inch. The axes of pressure rollers 54 are slightly skewed with respect to each other in order to maintain the rollers in contact. Otherwise the rollers would tend to deform thereby leaving a gap between them at their nip. The rollers 54 are rotated such that the speed of a copy sheet through the rollers is slightly slower than the speed at which the copy sheet is fed toward the rollers. This is necessary in order to assure that the rollers do not prematurely pull the copy sheet from the photoreceptor belt 40, i.e. before transfer of toner to the copy sheet is complete, the latter would result in an imperfect, streaked copy. Hence, the copy sheet is permitted to buckle slightly before it is completely fed through the rollers 54. Such a slight buckle does no damage to the loosely held toner image that is carried on the copy sheet. Under the influence of the high pressure exerted on the pressure fixable toner by rollers 54, the image is permanently fixed to the copy sheet as it passes through fixing rollers 54 and into the receiving tray 56.

After the developed image is transferred, a residual latent electrostatic image and some untransferred toner remain on the photoreceptor belt 40. As the belt 40 continues along its path, it is carried past a single wire discharge corona 58 which neutralizes any charge on the untransferred toner. Next, the belt 40 passes underneath an array (preferably four) of incandescent erase lamps 60. Light from the erase lamps 60 illuminate the belt 40, discharge the residual latent image areas of belt 40 and thereby erase any remaining residual electrostatic image.

As the photoreceptor belt 40 begins its second cycle, the carriage 12 starts to return from its extreme left position toward its extreme right or home position. During the second cycle, the corona charger 32 and the transfer corona 51 are de-actuated. By virtue of the effects of the erase lamps 60 and discharge corona 58, the untransferred toner is now only loosely adhering to the photoreceptor belt 40. As the untransferred toner passes the magnetic brush 37, the latter attracts the untransferred toner from the belt 40 onto the magnetic brush 37. Hence, the magnetic brush 37 performs two functions: on the first cycle the magnetic brush 37 develops the latent electrostatic image and on the second cycle the magnetic brush 37 cleans the photoreceptor of any untransferred toner. Thus, after the second cycle, the photoreceptor belt 40 is cleaned of toner and ready to make another copy.

As is readily apparent from FIG. 1, most of the major operating components of the copier 10 are disposed between the ends of the Z-shaped optical paths, i.e., between tilted mirrors 22 and 26. In particular, the photoreceptor belt 40, the charging station (charger) 32, the developing station 36, the transfer corona 50, the discharge corona 58 and the erase lamps 60 are all disposed in a relatively compact volume of space that is vertically bounded by the ends of the path of the Z-shaped optical system. Hence, the shape of the optical system cooperates with the physical location of major operating elements to yield a plain paper copy machine of compact proportions.

Moreover, the above-described optical system 21 substantially reduces the structure that is ordinarily needed to support the reciprocating carriage 12. The relatively light structure for supporting the carriage 12 is shown in FIG. 8, where one side of the carriage 12 is supported by guide rail 80 that has upper and lower slide grooves 81*a, b*. A plurality of slidable mounting brackets 82 each include a pair of grooves 83*a, b* juxtaposed to the slide grooves 81*a, b*. A plurality of ball bearings 84 freely revolve in the juxtaposed grooves 81*a, b* and 83*a, b*. A plurality of hinges 85 (one for each mounting bracket) have one end connected to one side of platen 14 and the other end connected to one of the mounting brackets. A stationary slide rail 86 supports the side of the platen 14 that is opposite to the hinged side. In the preferred embodiment, the platen 14 is sixteen and one-half (16½) inches long and in its travel overhangs the copier 10, by no more than ten (10) inches. Such a relatively small overhang is achieved due to of the location of the exposure window 27 away from the ends of the copier and towards the center of the top of the machine 10. Hence, as mentioned above, the Z-shaped optical systems enables the window 27 to be located away from the end of the copier and still perform its function.

The Upper Support Assembly

Figure 2:
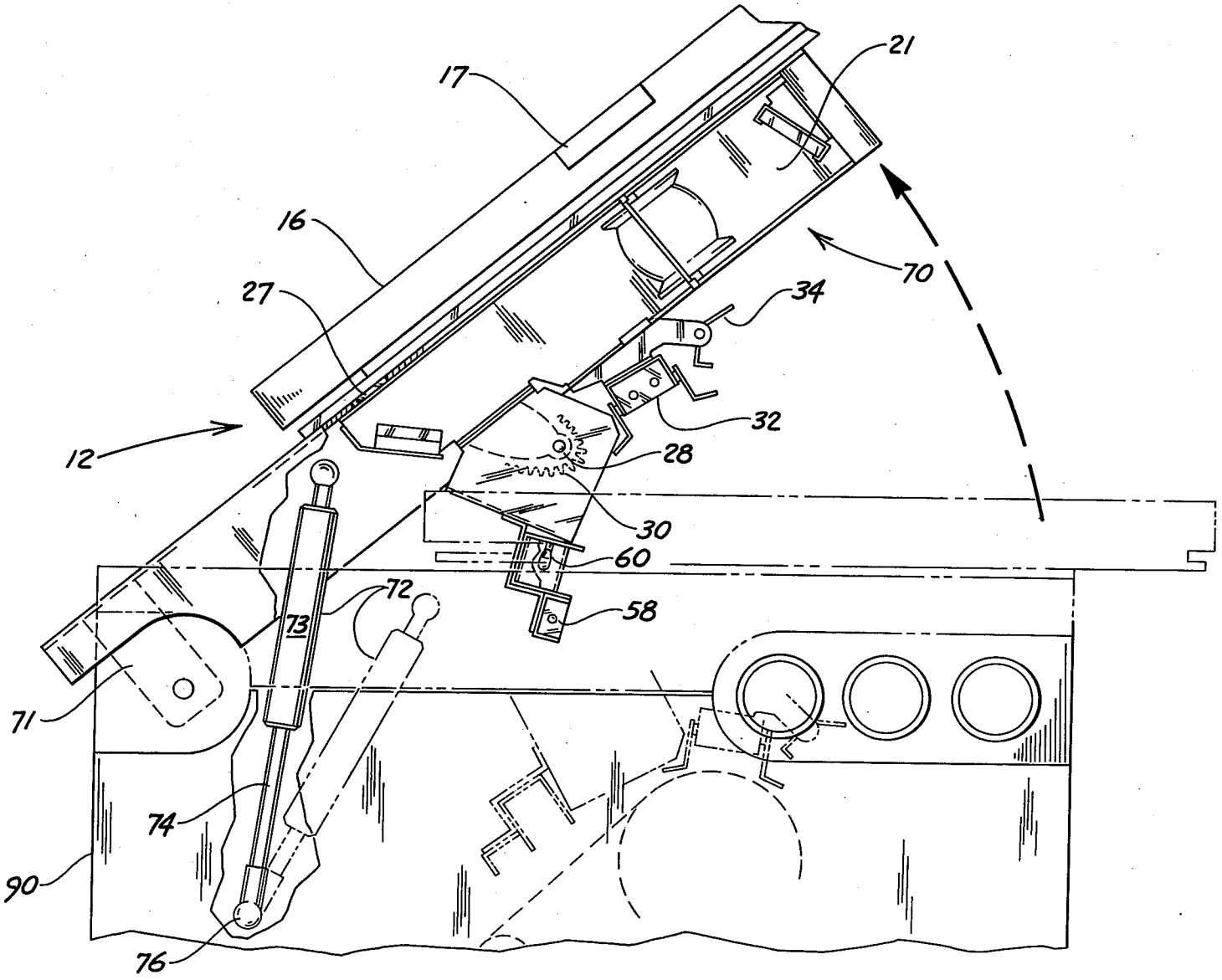
FIG. 2 is a partial elevation view showing the upper support assembly in its raised position (solid lines) and in its operative position (phantom)

Turning now to FIG. 2, there is shown one of the advantages of the invention which includes the upper support assembly 70. Mounted on the assembly 70 are the following components: the carriage 12, the illuminating window 27, the Z-shaped optical system 21, the illuminating lamps 28 and reflector 30, the discharge corona 58, the array of erase lamps 60, the charging corona 32 and the shutter 34. The upper support assembly is pivotably connected to a central frame 90 through an elongated C-shaped bracket 71. The central portion of bracket 71 is fixedly connected to the underside of the left end of the upper support assembly. The two ends of the bracket 71 are pivotally connected to the respective vertical portions of upper support assembly and to central frame 90.

A pneumatic support 72 includes a gas cylinder 73 and an extendable rod 74 which has one end pivotally connected to central frame 90 and the other end pivotally connected to upper support assembly 70. When the upper support assembly 70 is raised to gain access to the copier 10, the pneumatic support 72 keeps the upper support assembly 70 in its raised position as shown in FIG. 2. When the upper support assembly 70 is lowered into its operative position, the extendable rod is retracted into the cylinder 73.

The Central Frame

Most of the other operating components are mounted inside the central frame 90 of the copier 10. One side of the central frame 90 includes a casting (not shown) which provides a cantilever support for one end of the drive roller 40. The support for the other end of the drive roller 40 will be described below. Except for those components supported by the lower support assembly 100, the remaining components are suitably mounted inside the central frame 90 in their relative positions as shown in FIG. 1.

The Lower Support Assembly

Turning to FIGS. 5A, 5B, 6A, 6B lower support assembly comprises a removable drawer 104 which consists of two roughly triangular shaped side walls 105, 106, a base plate 107, and an end plate 108. The side walls 105, 106 are fixedly mounted on the base plate 107 at a predetermined distance from the respective edges thereof. Two camming surfaces 95, 96 are respectively located between side walls 105, 106 and the corresponding edge of base plate 107. The camming surfaces 95, 96 perform a number of functions that will be explained below. The drawer 104 can be entirely removed from the copier 10 by one who may grasp and pull on handle 109 that is part of the end plate 108.

As mentioned above, the drawer 104 supports a number of operating components that are located underneath the photoconductor belt 40. The transfer corona 51 extends across and is supported by the forward, flattened ends of the side walls 105, 106. A pair of opposing elongated U-shaped slots 110, 111 are provided, one for each side wall 105, 106 and disposed in back of the transfer corona 51. The queuing rollers 48 are supported and positioned in the slots 110, 111. Springs 112, 113, one on each side wall 105, 106, wrap around the ends of queuing rollers 48 to hold them together. A drive gear 114, mounted on one of the rollers, projects beyond the spring 112 for engaging a clutch, CL2, which selectively couples the drive from the main motor 60 to the queuing rollers 48 in order to feed a copy sheet into contact with the developed image carried on the photoconductor belt 40.

A paper tray 102 is also supported by the drawer 104. The tray 102 is generally supported at approximately a ten degree angle to the horizontal. At such an angle, the copy sheets in the tray are urged by their own weight against the forward wall 103 of the tray. Side walls 101*a, b* of tray 102 have upper cut-away portions 99*a, b* near the forward wall 103. Those cut-aways 99*a, b*, respectively, engage lips 115*a, b* that are disposed on the inside drawer side walls 105, 106. An opening is provided in the base plate 107 in order to position the tray 102 so that cut-aways 99*a, b* mate with lips 115*a, b*. Hence, the tray 102 is supported at about a ten degree angle.

The drawer 104 also supports the copy sheet feed rollers 46. Two more U-shaped slots 116*a, b* are respectively provided in the drawer side walls 105, 106. The axis of feed rollers 46 extends across the drawer 104 and is supported by the side walls 105, 106 in the slots 116*a, b*. A gear 117 is mounted on one end of axis of the feed roller 46. A clutch CL3 (not shown) selectively couples the sprocket 117 to the motor 60 in order to feed the top most copy sheet from the supply of sheets 45. The copy sheet tray 102 is positioned underneath the feed roller 46 so that the uppermost copy sheet is fed from the supply 45 when the clutch CL3 is actuated.

Figures 3A, 3B:
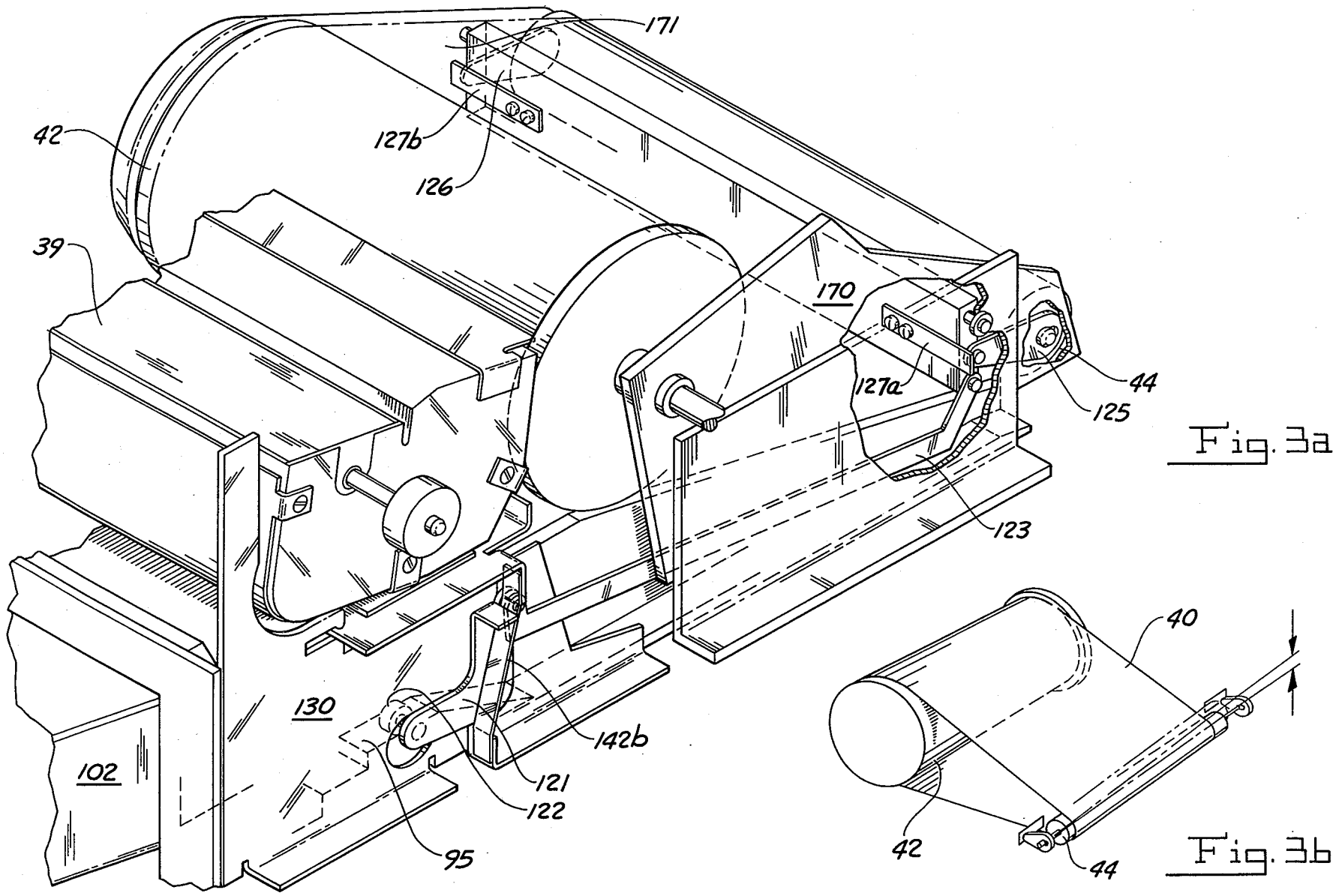
FIG. 3A is a partial, broken-away end perspective internal view of one side of the magnetic brush, the photoreceptor belt and rollers, and the lower support assembly.
FIG. 3B is a partial perspective of the idler roller skewing mechanism.
Figure 4:
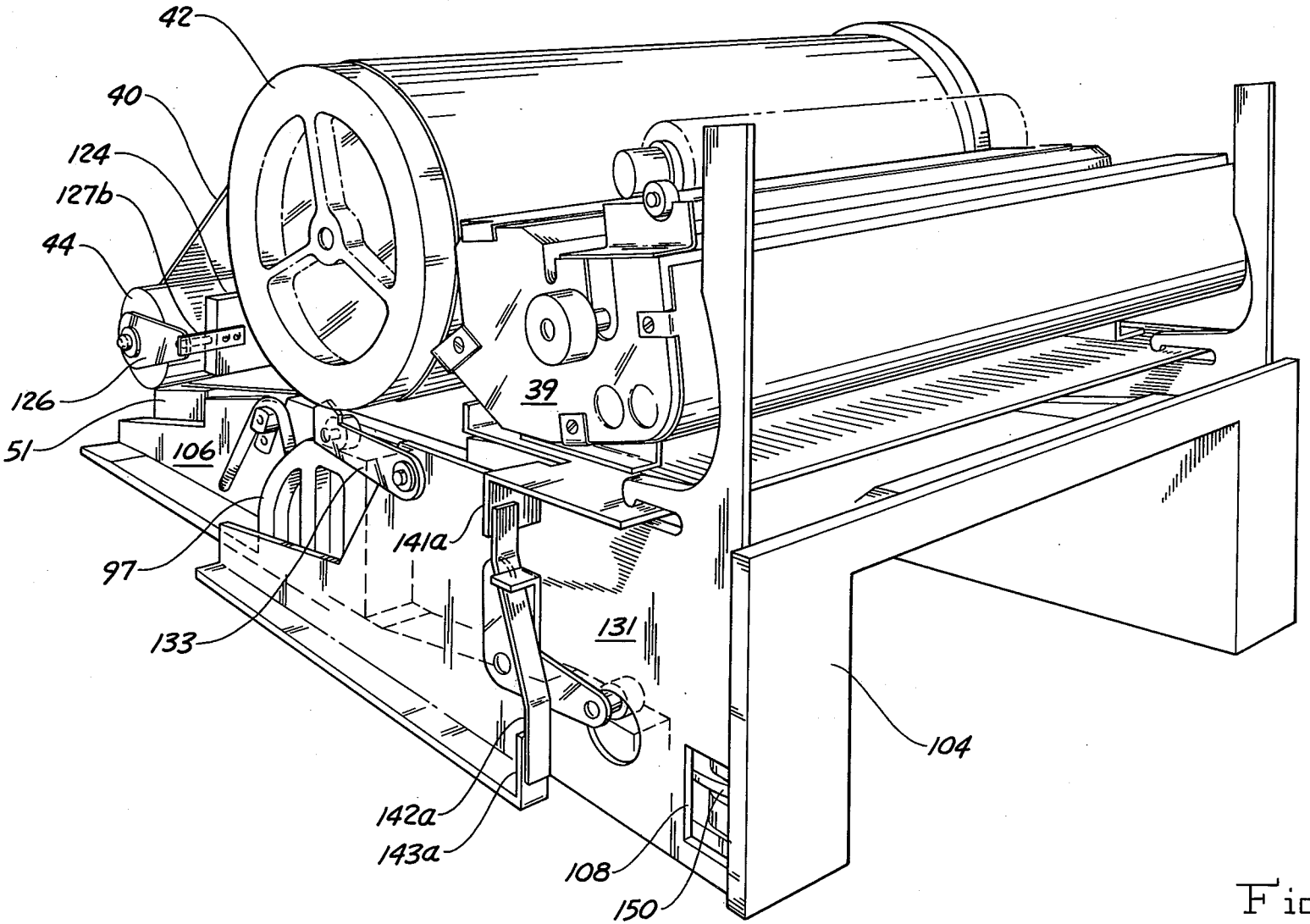
FIG. 4 is the same type of view FIG. 3A, but is taken from the opposite side of the machine.
Figures 5A, 5B:
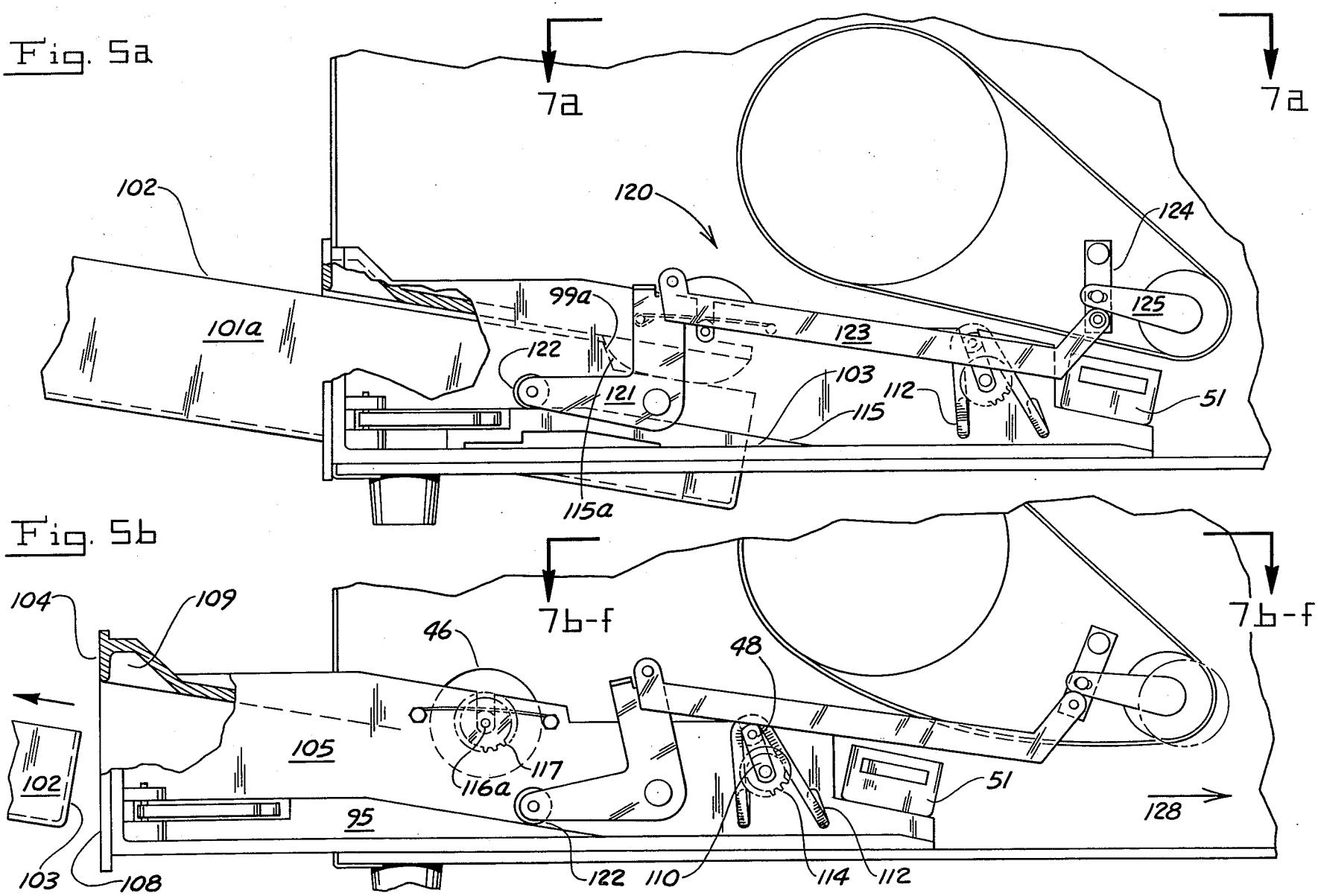
FIG. 5A is an elevation view of the skewing mechanism in its operative position.
FIG. 5B is an elevation view of the skewing mechanism in its relaxed position.

As mentioned above, there are camming surfaces 95, 96 along the outside edges of base plate 107. An idler roller positioning linkage 120 as shown in FIG. 3A includes an elbow bracket 121 that is pivotally mounted at its corner to magnetic brush support wall 130. A roller 122 for engaging and riding on camming surface 95 is connected to one end of the elbow 121. The other end of elbow 121 is pinned to a connecting arm 123. An idler roller positioning bar 124 extends across the width of the copier 10, behind the idler roller 44. The upper end of the bar 124 is pivotally mounted to and supported between internal walls 170, 171. The lower end of bar 124 is pinned to the connecting arm 123. A short link 125 is pinned at one end to the bar 124 and the other end of link 125 is coupled to the axis of idler roller 44. Another short link 126 is similarly connected between the other end of idler roller 44 and the corresponding end of positioning bar 124. Leaf springs 127*a, b*, one on each end of bar 124, are biased against the connecting links 125, 126 in order to urge the link (and the idler roller 44) in the direction indicated by arrow 128.

In operation, as drawer 104 is inserted, roller 122 rides up on camming surface 95, thereby moving elbow 121 about its pivot in a clockwise direction. In response to the turning of elbow 121, the connecting arm 123 is urged in a direction toward the idler roller 44. The motion of the arm 123 is imparted to both sides of the idler roller 44 through the positioning bar 124 and the short connecting links 125, 126. Hence, the idler roller 44 is moved in the direction of arrow 128 to thereby appropriately tension the photoreceptor belt 40 and to slightly skew the axis of idler roller 44 with respect to drive roller 42. The proper skewing is obtained by mounting the axis of idler roller 44 in end slots in walls 170, 171, at different elevations with respect to each other. Those skilled in the art will appreciate that there are a number of equivalent techniques which would achieve the same skewing effect.

Figure 6A:
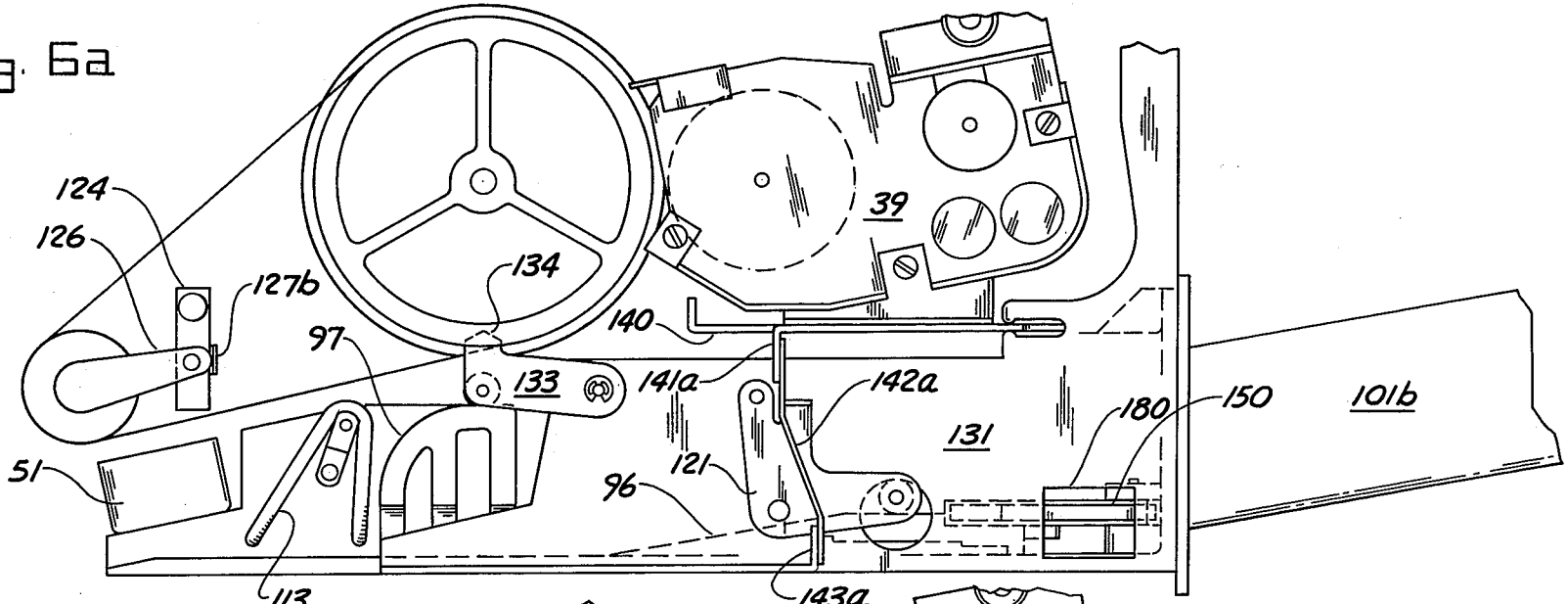
FIG. 6A is an elevation view of the tensioned photoreceptor belt in registration with the magnetic brush that corresponds to FIG. 5A.
Figure 6B:
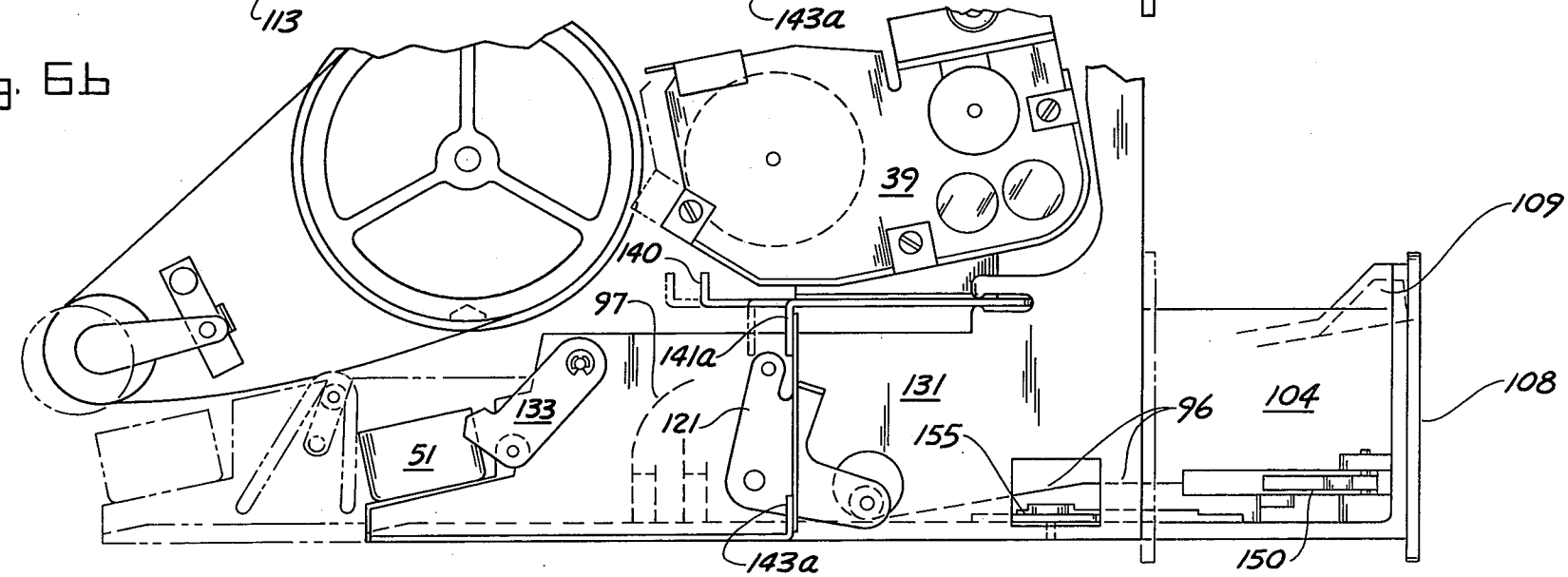
FIG. 6B is an elevation view of the relaxed photoreceptor belt out of registration with the magnetic brush that corresponds to FIG. 5B.
Figure 7A:
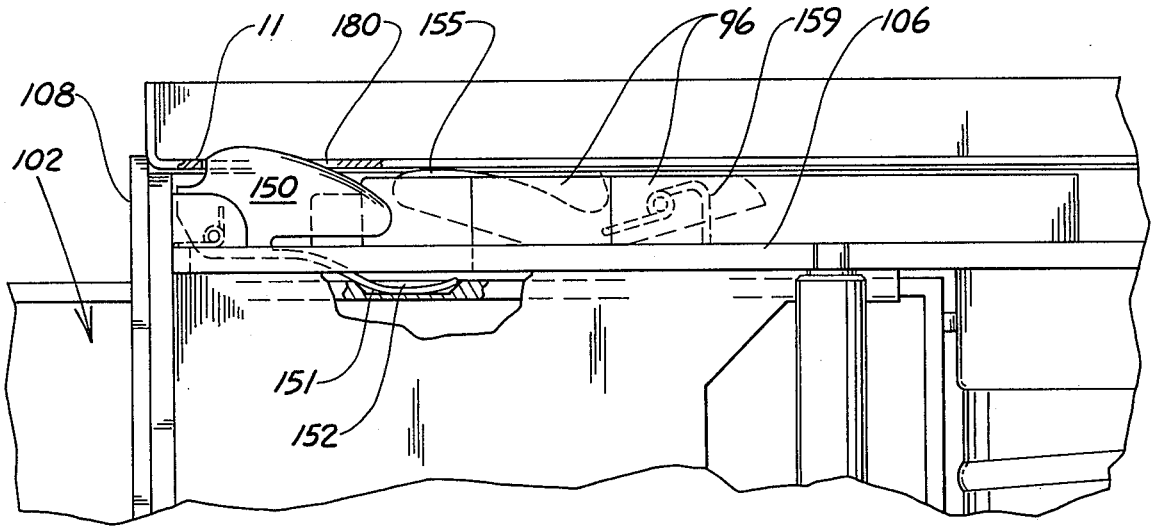
Figure 7B:
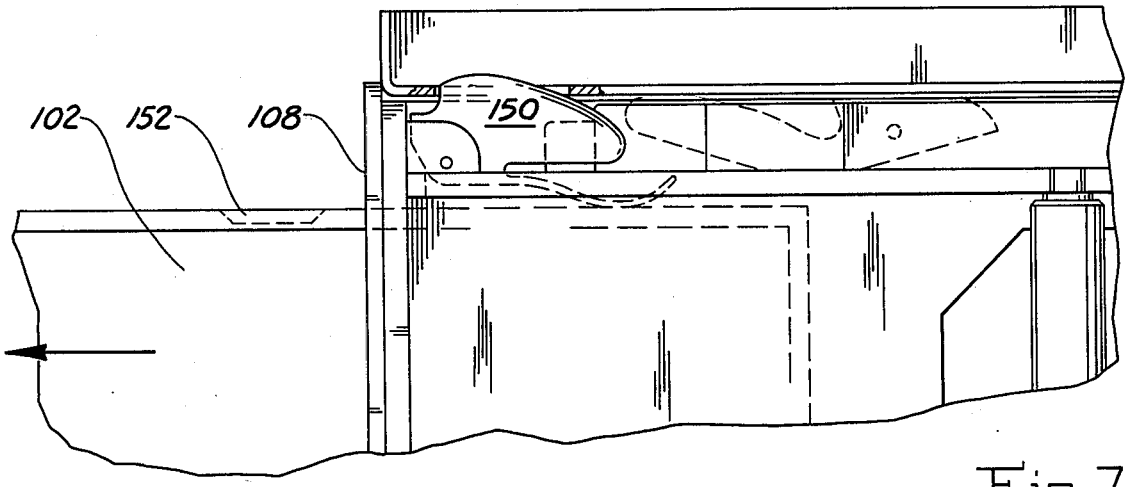
Figure 7C:
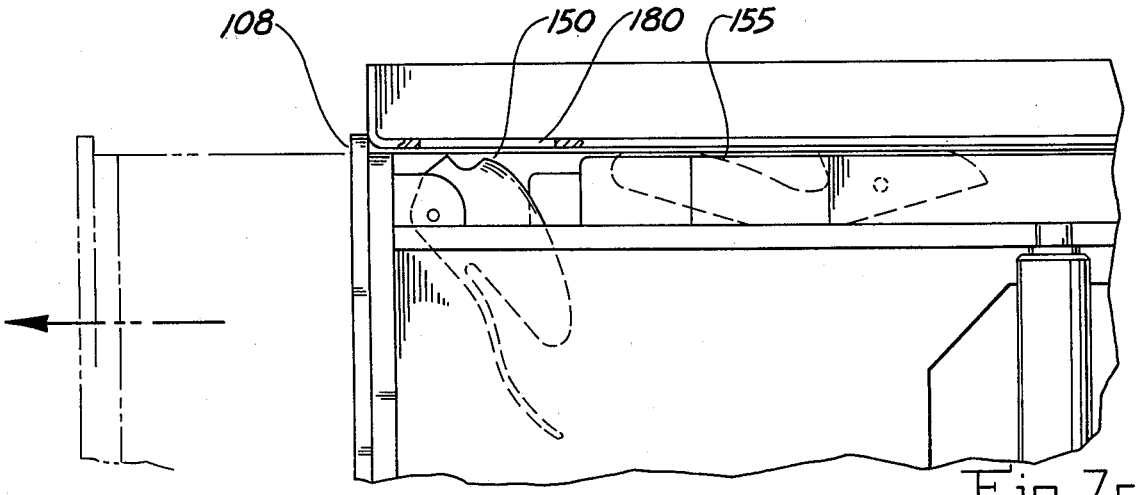
Figure 7D:
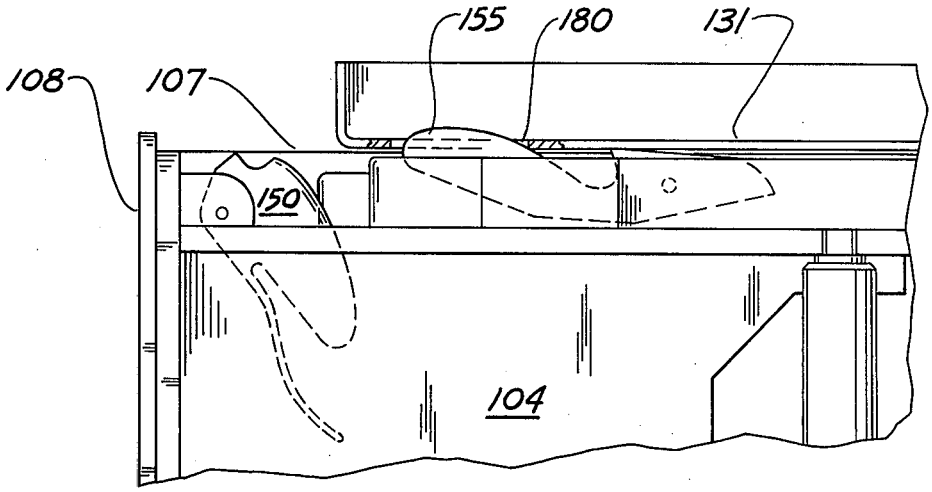
Figure 7E:
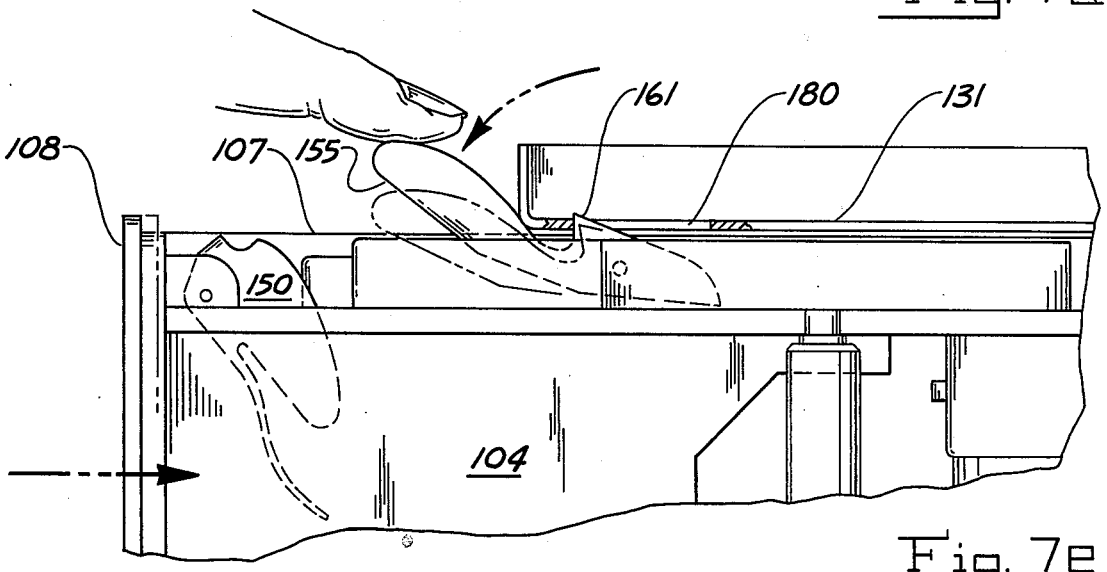
Figure 7F:
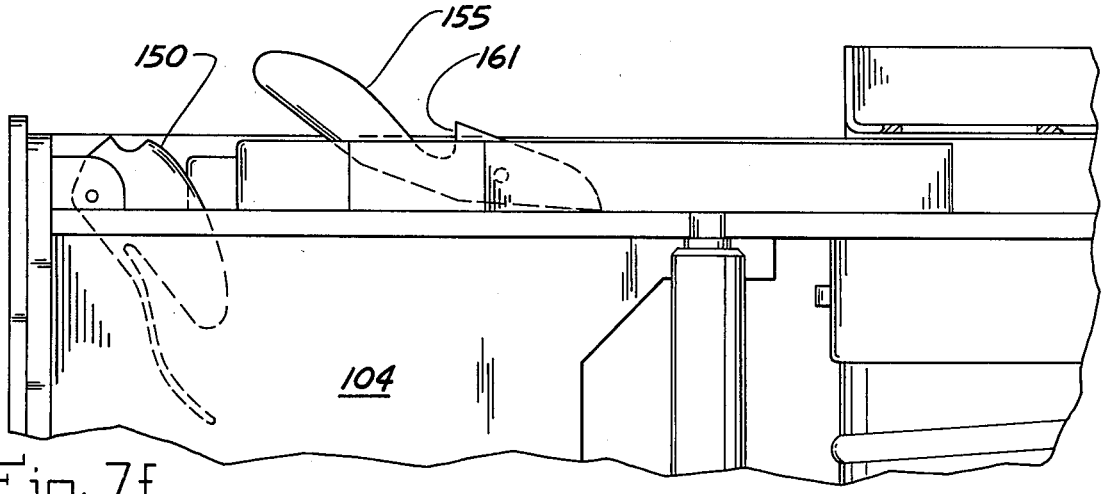

The elbow bracket 121 also functions to move the magnetic brush developer 39 into and cut of its operative position with respect to the photoconductor belt 44. Turning to FIGS. 6A and 6B the developer 39 is shown mounted on a slide plate 140. The plate is slidably supported in horizontal slots of internal magnetic brush support walls 130, 131. A vertical flange 141*a* projects downward from slide plate 140. An elongated leaf spring 142*a* is coupled between the slide plate flange 141*a* and a base flange 143*a* that projects upward from the bottom of internal wall 131. Hence, as the drawer 104 is inserted, the elbow 121 pushes against spring 142*a* and thereby urging slide plate 140 toward the photoreceptor belt. A similar flange and spring arrangement operates on the other side of the slide plate 140 as shown in FIG. 3B. Likewise, as the drawer 104 is withdrawn, the leaf springs urge the slide plate (and thus the developer 39) away from the photoreceptor belt 40.

The remaining camming action accomplished by drawer 104 is also shown in FIGS. 6A, 6B. The arched cam surface 97 is mounted on the base plate 107 of drawer 104. A pointed support arm 133 is rotatably mounted at one end to interior wall 131. The other or pointed end of arm 133 is urged by cam 97 into a notch 134 provided in the end support 135 of drive roller 42. The other end of drive roller 42 is supported in cantilever fashion by axis 136 that is rotatably mounted on the frame plate 137 which is another interior wall.

The proper position for the copy paper tray 102 is determined by a retaining clip 150, as shown in FIGS. *7a–7c*. The clip 150 is pivotally mounted on the drawer 104 and has a resilient arm 151 that presses against the side wall 101*b* of the tray 102. A recess 152 is provided in side wall 101*b* for receiving the resilient arm 151 so that cam surface 155 passes through copier wall opening 180 and abuts against side frame 11 thereby resisting further movement of the tray 102. An operator can sense this resistance and thus know that the tray 102 is properly in place. The resistance of the arm 151 is easily overcome, so that tray 102 can be withdrawn to replenish its supply or to change paper size.

A drawer retaining cams 155, on one side of the drawer 104, permits the operator to partially withdraw the drawer 104 to an intermediate position where the photoreceptor belt 40 is slackened (as shown in FIG. *2b*) and the magnetic brush is away from the belt 40. Turning to FIGS. *7d–f*, the cam 155 is pinned at one end of the base plate 107 of the drawer 104. A spring 159 coupled to the cam 155 biases the cam to move outwardly or in a clockwise direction. The side frame 11 has an opening 180. As the drawer 104 is withdrawn, the leading edge of cam 155 is urged into the opening 180. The curved shape of the leading edge rides out of the recess and the drawer 104 is withdrawn until the corner 161 is urged into opening 180 and abuts against side frame 11. At that position, the photoreceptor belt 40 is unloaded or slacked and the magnetic brush is moved away from drive roller 42. If an operator wishes to remove the entire drawer 104, he can manipulate the leading edge of cam 155 so as to cause corner 161 of cam 155 rotate counter-clockwise out of opening 180 whereupon the entire drawer 104 is easily withdrawn.

The Control System

The control system 200 (as shown in FIG. 9) includes a motor supply and lamp network 201, a clutch control network 202, an erase lamp network 203 and a power supply network 204. Any 115 volt A.C. outlet may be used to supply power to the copier 10. A fuse F1 is connected between the A.C. source and the machine. A safety interlock switch S1 has switch arms S1A and S1B which open when the upper support assembly 70 is raised. The two motors 62, 63 are energized through contacts K1-1 and K1-2 of main relay K1. The exposure lamps 28 are energized through switch S2 and triac firing circuit 205.

Transformer T1 and full wave rectifying bridges B1, B2 provide D.C. power for the rest of control system 200. In particular, the output of B1 supply power to the erase lamps 60 which are always on during operation of the copier 10, B1 also supplies power to high voltage corona supplies, B3, B4 and B5.

High D.C. voltage supplies, B3, B4 and B5 energize the corona charges 32, 51, 58 and to apply a D.C. bias to the magnetic brush 37. A substantial reduction in the size of such D.C. supplies is achieved through the use of a high frequency oscillator circuit 206. Transistors Q5, Q6 have their emitters connected in common and their bases connected to opposite ends of the primary side of hysteresis transformer T2. The secondary side of T2 is connected to charger power transformers T3, T4, T5 where the high voltage A.C. output of T2 is further transformed and rectified by rectifiers B3, B4, B5 to provide the −6.5 KV, 5.5 KV and −5.5 KV D.C. voltages for corona charger 32, the discharge corona 58 and the transfer corona 51. Potentiometer P1 provides the −350 V D.C. bias for the magnetic brush 37. Switches S8 and S9 are disposed between T2 and the charge and transfer transformers T3, T5 and thereby control the charging corona 32 and the transfer corona 51. Discharge corona 58 is on during substantially the entire operation of the copier 10.

The remaining controls for copier 10 are provided in clutch network 202. The copier 10 has four electromagnetic clutches CL1-4. Clutch CL-1 couples the motor 62 to the main drive chain 61. Paper feed clutch CL2 is operable to couple the paper feed rollers to drive chain 61. Similarly, clutches CL3 and CL4 respectively couple the queuing rollers and the drive roller 42 to drive chain 61. The four clutches CL1-4 are schematically represented as coils in control network 202. Each clutch has one or more current paths that are capable of energizing the clutches in a manner that will be more fully explained later.

The main relay K is similarly represented as a coil. As already mentioned, contacts K1-1 and K1-2 of relay K1 control the motors 62, 63. A third contact K1-3 is self-maintaining and keeps relay K actuated so long as current is supplied to relay K1.

There are several available current paths which will energize relay K. One such path is provided by a pulse circuit including transistor Q1 and diodes D9, D10. Another path is provided through multicopy switch S5 when it is transferred to its MC position. Drive roller control switch S6 and D9 also provide a current path for K1 as does queuing roller switch S7 and D7. A final current path is provided by S6 through D9.

Phototransistor Q3 is mounted underneath the photoreceptor belt 40 to one side thereof. The belt 40 has a relatively narrow notch 8, approximately one inch long and disposed near the edge of the belt 40 and out of the imageable control portion thereof. Light emitted by the erase lamps 60 passes through the notch 8 and strikes the phototransistor Q3. When Q3 is illuminated, Q4 is turned off thus deenergizing drive roller clutch CL4 and the belt stops. Since the belt 40 makes two revolutions per copy, the effect of Q3 is negated during the first revolution by switch S6 which is closed at the time the notch 8 passes over Q3. The remaining transistor Q2 in clutch network 202 serves a purpose similar to switch S6. During a multicopy operation, Q2 pulses Q4 at the end of the second revolution of the belt in order to restart clutch CL4 for the next copy.

As shown in FIG. 1, a bank of control cams are rotatably mounted for operating an array of control switches 66. The switches in array 66 include S2 (exposure lamps), S4 (copy sheet feed rollers), S6 (drive roller), S7 (queuing rollers), S8 (charge corona), and S9 (transfer corona), the components in each parenthesis being the operating component in copier 10 that is controlled by the proceeding switch. Each cam in the bank is eccentrically shaped to open and close its corresponding switch at a predetermined time in the copy cycle. For a given copy cycle, the bank of cams 64 rotates once or 360°. During that time, the photoreceptor belt 40 makes two revolutions. In the preferred embodiment, the belt 40 is eighteen inches long in order to accomodate legal size copies and so the belt travels thirty-six inches for one copy. FIG. 10, contains a bar chart which relates the operation of the control switches 66 and the occurrence of key events to the degrees of rotation of the cams 64 and to the distance of belt travel. The bars associated with the switches indicate the angular positions of the eccentric camming surfaces of each cam with respect to each other.

The Drive System

The drive system 180 of the copier 10 is illustrated in FIG. 8. As mentioned above, there are two motors, the main motor 62 and the fuser roller motor 63. The latter drives the fuser rollers 54 through drive chain 182 that is coupled around fuser roller drive sprocket 183 and fuser motor sprocket 9. The magnetic brush 37 is also driven by the fuser motor 63 by means of drive sprocket 13 that is coaxially mounted with the fuser roller drive sprocket 183. The output of drive sprocket 13 is transmitted to magnetic brush drive sprocket 15 via drive chain 57 and idler or tensioning sprocket 185.

The carriage 12 and the other driven components are driven by the main motor 62. A carriage drive chain 65 travels around two sprockets 69*a,b* that are disposed one near each end of the path of the carriage. A yoke 67 is coupled to the carriage and a drive pin 68 is coupled to the drive chain 65 and vertically movable inside yoke 67. Carriage sprocket 69*a* is coaxially mounted on the drive shaft of main motor 62. As the motor 62 turns, the chain 65 is driven around the sprockets 69*a,b*. The drive pin 68 pulls the yoke 67 (on carriage 12) along with the chain 65. As the pin 68 travels around either sprocket 69*a,b*, the carriage is first slowed and then reversed in its direction of travel to achieve reciprocal motion.

Main drive chain 61 supplies drive to the remaining driven elements. The paper feed rollers 46 are connected to the drive chain 61 through meshed spur gears 23, 25, driven by sprocket 1 and clutch CL2. Similarly, queuing rollers 48 are connected to drive chain 61 through spur gears 31, 33, driven by sprocket 2 and clutch CL-3. Drive roller sprocket 43 supplies drive to the large diameter drive roller 42 through clutch CL4. The bank of cams 64 is driven off of cam sprocket 4 through coaxial reduction gears 3*a,b*. The gear reduction is such that cams 64 will turn through one complete revolution for two revolutions of the photoconductor belt 40.

Sequence of Operations

When print switch S3 is closed, power is applied to transformer T1, thereby energizing the erase lamps 60, the cleaning corona 58 and applying the −350 volt D.C. bias to magnetic brush 37. In the clutch control network 202, the main clutch CL1 is energized. In addition, the RC circuit, including R7 and C10, turns on Q1 for approximately 400 miliseconds, i.e., until C10 charges to its capacity. With Q1 on, power is supplied to main relay K1 through diodes D9, D10. As a result, the three contacts of relay K1 close so that K1-1 applies power to main motor 62, K1-2 applies power to motor 63 and K1-3 maintains power to T1. The drive roller clutch CL4 is also energized through Q1 and diodes D11, D10. Hence, the motor 62 is energized, the carriage begins its travel toward and across the illuminating area and the photoreceptor belt 40 is turning as is the bank of cams 64.

After the cams 64 have turned 6° (corresponding to approximately one-half inch of belt 40 travel), cam switch S2 closes and the exposure lamps 28 are energized.

As mentioned above, Q1 will turn off when C10 is fully charged. Accordingly, the cam operated belt control switch S6 is set to transfers at 5° of rotation, before C10 fully discharges, in order to to provide an alternate and continuous path of power to main relay K1 and drive roller clutch CL4 in order to keep belt 40 moving along its predetermined path.

At 10° copy paper switch S4 transfers, thereby energizing paper feed clutch CL2. The copy paper feed rollers start to turn and feed the uppermost copy sheet into the nip of the still idle queuing rollers 48. Switch S4 opens at 38°, thereby leaving a copy sheet slightly buckled between the copy paper feed roller 46 and the nip of the queuing rollers 48.

At 21°, the charge corona switch S8 transfers thus energizing corona charger 32 through the −6.5 KV D.C. power supply. Accordingly, as the photoreceptor belt 40 passes underneath corona charger 32 the zinc oxide photosensitive layer is uniformly charged. As described above, the image of the document that passes over the exposure slit 27 is cast upon the charged photoconductor 40 at the imaging station 34. The light-struck areas of belt 40 are discharged to yield a latent electrostatic image. As that image passes the magnetic brush 37, toner particles 39 are attracted and adhered to the electrostatic image, thereby rendering it visible or developed.

As the developed image is carried toward the transfer station 51 and the cams turn 100°, queuing roller control switch S7 transfers to energizes the queuing roller clutch CL3. The copy sheet that had been inserted into the nip of the idler queuing rollers 48 is fed by the rollers 48 in synchronism with the developed image so that the image and the copy sheet reach and pass through the transfer station 50 in registration with each other. As the image and the copy sheet approach the transfer station 50, transfer corona control switch S9 closes (116°) thereby connecting the transfer corona 51 to the −5.5 kv D.C. power supply. At the transfer station 50, toner particles are attracted and adhere to the copy sheet which continues to move into the nip of fixing rollers 54. Under the pressure of those rollers, the toner is permanently fixed to the copy sheet which is then deposited in receiving tray 56.

As the cams 64 turn respectively through 165°, 180° and 185°, the corresponding respective control switches S8, S2 and S6 open thereby turning off the corona charger 22 and the exposure lamps 28 and terminating the power path to relay K1 through S6. Main relay K1 is maintained through the alternate power path provided by S7, the queuing roller clutch control switch.

Drive roller clutch CL4 is maintained through transistors Q3, Q4. It will be recalled that Q3 is a phototransistor which will shut off Q4 (and thus stop the drive roller 42) when light strikes Q3. The latter will occur when the notch 8 in photoconductor belt passes over Q3. At the end of the first cycle or revolution of belt 40, the effect of Q3 is negated by control switch S6. That switch S6 maintains a power path to CL4 through 185° which is long enough for the notch 8 to have completely passed over Q3. Hence at the start of the second cycle of belt 40, Q3 is dark and the drive roller 42 continues to turn and the carriage 12 begins its travel back toward its home position. During the second revolution of photoreceptor belt 40, the transfer operation is completed, and transfer control switch S9 opens and transfer corona 50 is de-energized.

As mentioned above, the discharge corona 58 and the erase lamps 60 are energized for substantially all the time during the two cycles of the belt 40. The leading edge of the residual latent image, bearing untransferred toner passes underneath discharge corona 58 which neutralizes any charge that was induced on the toner by the transfer corona 51. The erase lamps 60 illuminate the photoreceptor to discharge the residual latent electrostatic image. With the remaining toner neutralized and the photoreceptor discharged, there is little or no force left to hold the remaining toner to the photoreceptor belt 40. Hence, as the belt 40 is moved passed the magnetic brush 37 during the second cycle, the brush attracts the toner away from the belt 40, thereby cleaning it.

The belt 40 continues to turn until notch 8 passes over the phototransistor Q3. Light from the erase lamps 60 shines through notch 8 on Q3 thereby turning off Q4. With Q4 off, the remaining power path for CL4 is interrupted, thereby de-energizing the drive to roller 42. Next, switch S7 opens thereby terminating power to the queuing roller clutch CL3 as well as to the main relay K1. Accordingly, the three contacts of K1 open so that K1-1 turns off main motor 62, K1-2 turns off motor 63 and K1-3 turns off transformer T1. With T1 off, the D.C. voltage provided by bridge B1 is terminated so erase lamps 60 and cleaning corona 58 are de-energized. Likewise, the D.C. output of B2 is terminated, thereby opening main clutch CL1. The latter is a combined clutch and brake, so that all the machine components that are driven off motor 62 are braked to a stop.

When it is desired to make multiple copies of a single document, multicopy switch S5 is closed at the beginning of the first cycle of the first copy. Switch S5 is a distinct control switch that can be turned on and off by an operator. Alternatively, it can be combined with any one of a number of well-known automatic copy count controls (such as a pawl and ratchet mechanism) that will open switch S5 after a predetermined number of copies has been made. In either case, when S5 is transferred to its MC (multicopy) position, the main relay K-1 is kept energized through S5 and will remain so energized until the cycle is completed after S5 is opened. Likewise, the ground path to the base of Q2 which is normally maintained by S5 in its single copy (SC) position, is open thus permitting Q2 to be pulsed as explained hereinafter.

During multicopy operations, the foregoing single copy operations are substantially, sequentially repeated. However, at the end of the second cycle of the photoreceptor 40, when switch S7 transfers open, the main relay K1 remains energized through the path provided by S5 in its MC position. In addition, the opening of switch S7 results in a 100 ms pulse that is produced by the inductive coil clutch CL3 and capacitor C9. The 100 ms pulse is applied to the base of Q2 which in turn pulses Q4 thereby energizing CL4 long enough for the notch 8 to pass over Q3 which is similar to the way Q1 pulses CL4 at the beginning of a single copy. After notch 8 passes over Q3 and Q3 is darkened, Q4 is on thereby providing uninterrupted power to CL4. Q3 is similarly inhibited for each subsequent copy by S6 as in single copy operation. On the last copy, switch S5 is transferred to its SC (single copy) position, during the second revolution of the photoreceptor belt 40. With switch S5 in its SC position, the base of Q2 is grounded inhibiting the pulse to Q4 which would energize CL4 again. Also S5 is open so it interrupts the alternate ground path to main relay K1, so that when S7 open K1 is de-energized and machine stops as in single copy operation.

I claim:

1. An electrophotocopy machine for reproducing a copy of an original document onto a plain paper copy sheet, said machine comprising:

a relatively large diameter roller;

a relatively small diameter roller;

a photoreceptor belt including a conductive substrate having an outer surface coated with a photoconductive substance, said photoreceptor belt being movably mounted on said rollers for traveling along a predetermined path and able to separate a plain paper copy sheet when said copy sheet passes adjacent said small diameter roller, said rollers having their axes continuously angularly displaced relative to one another during copying operation, thereby urging said photoreceptor belt to move laterally in a predetermined direction toward one end of said rollers as said belt moves along its predetermined path;

means for illuminating an original document;

a reciprocating carriage for carrying said document across said illuminating means;

a plurality of means disposed adjacent said large roller for charging said photoconductive surface, for imaging said illuminated document on the charged surface to form a latent electrostatic image thereon, and for toning said latent image to render it visible;

means for feeding a copy sheet into contact with said toned image from said photoreceptor belt;

transferring means for substantially transferring said toned image from said photoreceptor belt to said copy sheet; and means for fixing said toned image to said copy sheet, said fixing means being operatively disposed with respect to said relatively small diameter roller for receiving said copy sheet as it separates from said photoreceptor belt when said photoreceptor belt passes around said small diameter roller.

2. The invention of claim 1 wherein said illuminating means includes an exposure slit through which said original document is illuminated and said imaging means includes an optical system having a Z-shaped optical path extending from one end at said exposure slit to the other end at said large roller, said optical path being substantially coextensive with and disposed above said photoreceptor belt, said charging, toning and transferring means.

3. The invention of claim 1 further comprising:

erasing and neutralizing means operatively disposed adjacent said photoreceptor belt, along said predetermined path and downstream from said transferring means for erasing said latent image and for neutralizing untransferred toner whereby said toning means can remove said untransferred neutralized toner from said photoreceptor belt as said belt travels past said toning means on its second cycle and thereby clean the photoreceptor belt preparatory to making a subsequent copy.

4. The invention of claim 3 wherein said electrophotocopy machine further comprises an upper, hinged support assembly for commonly supporting said illuminating means, said imaging means, said erasing and neutralizing means and said charging means whereby said support assembly can be pivotally opened in order to gain access to said photoreceptor belt and to said toning means.

5. The invention of claim 1 further comprising flange means mounted on one of said rollers on the end thereof toward which the belt laterally moves for maintaining the photoreceptor belt in a predetermined position.

6. In an electrophotocopy machine for reproducing a copy of an original document onto a copy sheet by transferring a toner image from a photoreceptor to said copy sheet, the improvement comprising a first roller, a second roller having a diameter smaller than said first roller, a photoreceptor belt movably mounted on said rollers for traveling in a predetermined path, and said rollers having their axes continuously angularly displaced relative to one another during copying operation, thereby urging the photoreceptor belt to move laterally in a predetermined direction toward one end of said rollers as the photoreceptor belt moves along its predetermined path.

7. The invention of claim 6 further comprising flange means mounted on one of the rollers on the end thereof toward which the belt laterally moves for maintaining the photoreceptor belt in substantially the same lateral position.

8. The invention of claim 6 wherein said machine further comprises a pair of spaced apart vertical support walls for rotatably supporting said rollers, and said first roller is axially disposed normal to both vertical walls and said second roller has its axis angularly displaced with respect to said first roller.

* * * * *